United States Patent [19]

Lauener

[11] Patent Number: 4,773,468

[45] Date of Patent: Sep. 27, 1988

[54] CASTING ROLL

[75] Inventor: Wilhelm F. Lauener, Gerlafingen, Switzerland

[73] Assignee: Larex AG, Recherswil, Switzerland

[21] Appl. No.: 47,470

[22] Filed: May 11, 1987

[30] Foreign Application Priority Data

May 14, 1986 [CH] Switzerland ..... 1964/86

[51] Int. Cl.[4] ..... B22D 11/06

[52] U.S. Cl. ..... 164/429; 29/121.1; 29/130; 164/428; 164/443; 165/89

[58] Field of Search ..... 164/428, 429, 448, 442, 164/423, 443; 165/89; 29/121.1, 130

[56] References Cited

U.S. PATENT DOCUMENTS

| | | | |
|---|---|---|---|
| 1,816,307 | 7/1931 | Reis | 165/89 |
| 2,171,132 | 8/1939 | Simons | 164/428 X |
| 2,936,158 | 5/1960 | Ramundo | 165/89 |
| 3,135,319 | 6/1964 | Richards | 165/89 |
| 3,625,280 | 12/1971 | Peter . | |

FOREIGN PATENT DOCUMENTS

| | | | |
|---|---|---|---|
| 0158207 | 10/1985 | European Pat. Off. . | |
| 8130270 | 11/1985 | Fed. Rep. of Germany . | |
| 2463318 | 3/1981 | France | 164/448 |
| 55-165262 | 12/1980 | Japan | 164/448 |
| 58-145342 | 8/1983 | Japan | 29/121.1 |
| 779656 | 7/1957 | United Kingdom | 164/448 |

OTHER PUBLICATIONS

Abstract of Japanese Patent Publication 60-121050(A) published Jun. 28, 1985.

*Primary Examiner*—Nicholas P. Godici
*Assistant Examiner*—J. Reed Batten, Jr.
*Attorney, Agent, or Firm*—Marks Murase & White

[57] ABSTRACT

Rods are placed into axially arranged grooves of the roll core. These rods protrude radially from the roll surface and the roll shell is shrink-fitted onto the rods. Due to the creeping movement of the roll shell which is a result of periodical heating and cooling thereof, the inside surface of the shell and the interfacing outside surface of each rod are subject to wear. Whenever this wear has proceeded beyond a tolerable limit the rods are replaced, whereafter a new shell with a normal inside diameter is again shrink-fitted onto the rods. Thereby the rod's and the shell's dimensions must never be changed. The roll core is not subject to wear. Stock-keeping and fabrication are particularly simplified due to the fact that the dimensions of the replacement parts never change.

7 Claims, 1 Drawing Sheet

CASTING ROLL

BACKGROUND OF THE INVENTION

Continuous casting machines with two counter-rotating casting rolls in between which molten metal is cast are known. (Herrmann, Handbook on Continuous Casting, edition 1980, p. 63, 64).

The casting rolls, hereafter called rolls generally consist of a roll core with a neck on both ends to accommodate the bearings, of a roll shell which is firmly fitted to the core and of the requisite components such as rotating glands, tubes, distribution pieces, gaskets and various small parts for the transportation of the coolant to and from the machine.

The roll core has grooves on its surface through which the coolant flows, whereby the heat which is conveyed from the cast to the shell is removed.

It is known to arrange the grooves in a circumferential direction or in a helical manner around the circumference or parallel to the axis of the roll core.

The outside surface of the shell which is exposed to thermal strains must be periodically reworked and the shell which is to be considered as a wearing part must finally be replaced.

Independent of the shape and arrangement of the grooves the shell is subject to a creeping motion on the surface of the core due to local, external heating and internal cooling, thus causing uneven wear of the core which therefore has to be remachined on a lathe by turning or grinding of the surface whereby the diameter diminishes accordingly.

In order to maintain the cross-section of the grooves for the flowing through of the coolant they must be reworked from time to time, a circumstance that demands a high expenditure of labour and corresponding work facilities. Finally, when the minimum diameter is reached the expensive roll core must be replaced.

Placing the grooves parallel to the axis of the core has a great advantage over other arrangements due to the fact that they can easily be cleaned by a rod with a corresponding cross-section, which can be pushed through the grooves in order to remove any sediments such as rust for example without removing the shell.

On the other hand the reworking of grooves that are parallel to the axis of the core is more laborious than that of grooves which are arranged in the circumferential direction of the core, due to the fact that the latter can be cut on a lathe in the same operation as the core surface is redone whereas the former have to be reworked on a milling or planing machine.

The remachining of the roll cores is costly. Furthermore the new shells have to be adjusted to the diameter of the corresponding roll core in order to ensure the requisite fit. This circumstance demands an individual production or the stock-keeping of shells with various inside diameters.

SUMMARY OF THE INVENTION

The present invention is based on the task of avoiding the reworking of the roll core so that this expensive operation is eliminated, whereby the core's durability is practically increased unlimitedly and it never need to be replaced due to reworking procedures. Furthermore roll shells with the same inside diameters can always be used whereby stock-keeping is substantially simplified. These improvements are achieved by providing a roll core having grooves with in-laid rods which protrude radially from the grooves and the roll shell is placed onto the rods.

The invention will now be explained more in detail by means of drawings that show an design example and several variants.

DESCRIPTION OF PREFERED EMBODIMENTS

Figure 1:
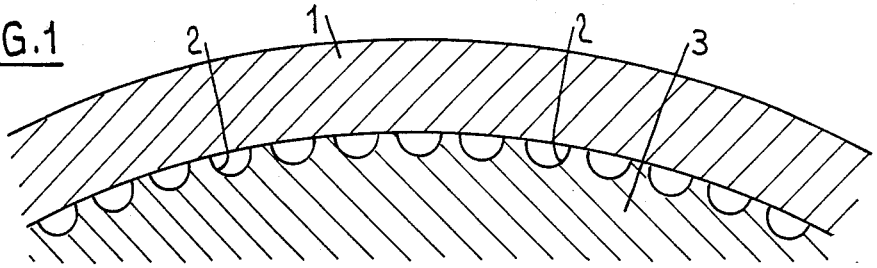
FIG. 1 shows a partial cross-section of a known type

FIG. 1 shows a cross-section of the known type. The shell is shrink-fitted to the roll core 3 which has grooves 2 along its generating lines. All of the above-mentioned problems with regard to wear and replacement of the roll cores as well as the stock-keeping of roll shells with various diameters are eliminated by the invention shown in FIG. 2.

Parts are designated identically to the corresponding ones in FIG. 1. The roll core 3 is furnished with grooves 2 that are placed on the surface and parallel to the axis of the core and rods 4 with rectangular cross-section that are laid into the grooves 2.

The roll shell 1 is shrink-fitted onto these rods. Thus channels 5 for the coolant are formed between the rods.

Instead of the above-mentioned reworking of the roll core 3, which is always accompanied by the replacement of the shell 1, the relatively inexpensive rods may be replaced if necessary. These rods can be kept in stock in one size. Due to the fact that no wear can occur in the grooves, the inside diameter required for the roll shells is always the same.

An important advantage of the invention consists in the fact that the rods can be fabricated of the best suited and heat treated steel, independently of the material the roll core is made of. Thereby the rod's resistance to wear and thus their durability can be improved substantially.

Figure 2:
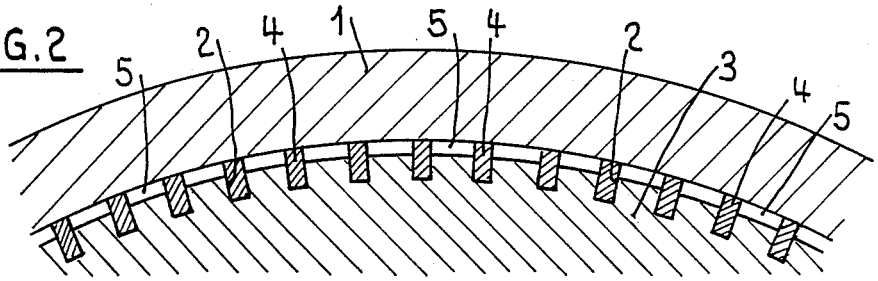
FIG. 2 shows a cross-section of a part of the design example
Figure 3:
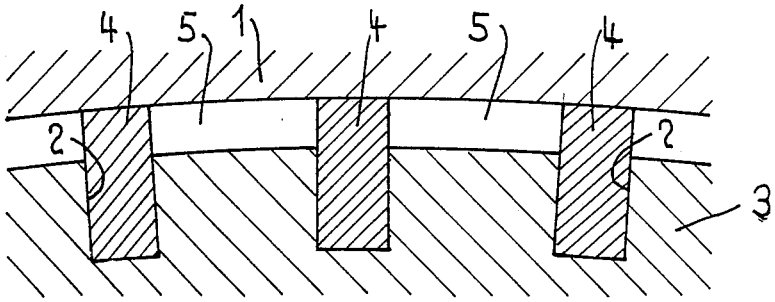
FIG. 3 shows a scaled up section of FIG. 2.
Figure 4:
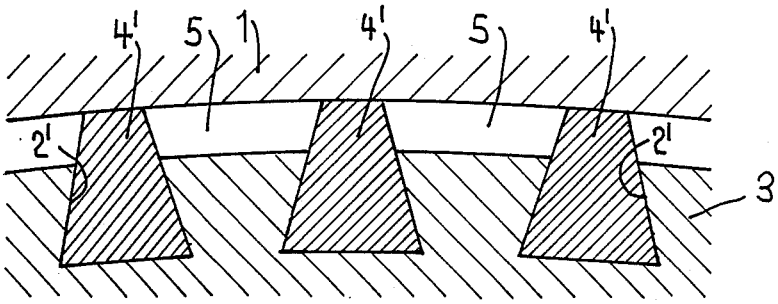
FIG. 4 and FIG. 5 show design variants
Figure 5:
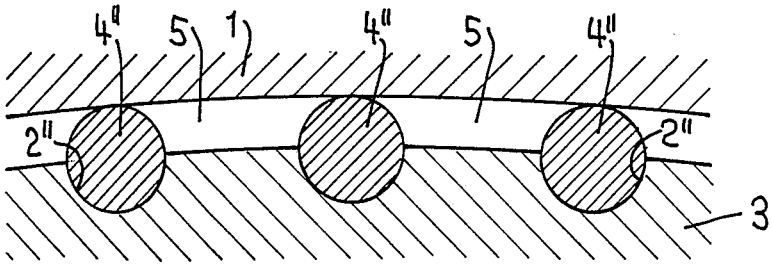

The cross-section of the rods may be rectangular as shown in FIGS. 2 and 3, whereby the bearing surface areas that interface with the shell 1 can be rounded according to the radius of the shell's inside surface. Other shapes may also be used, for instance rods 4' with trapezoidal cross-section which are inserted into the dovetail grooves 2' as shown in FIG. 4, or rods 4'' with circular cross-section that are placed into grooves 2'' with sector-shaped cross-section. A roll core with a diameter of 600 mm for example, is preferably furnished with 120 grooves. Thereby the resulting pitch is:

$$\frac{600 \times \pi}{120} = 15.7 \text{ mm}$$

If a rectangular rod is provided, the cross-section may measure $6 \times 12$ mm, whereby the rod is inserted 8 mm into and protrudes 4 mm from the core surface. Herewith the cross-sectional area of the channels for the coolant amounts to nearly $4 \times 9.7$ mm$^2$ and a wetted inside surface of the shell of $$\frac{15.7 - 6}{15.7} = 0.62 \text{ or } 62\%$$

In practice a wetted surface of 55–65% has proven to be very adequate. Thus the chosen rod thickness of 6 mm yields a favourable result.

As mentioned above one benefit among others, derived from eliminating the need of changing the core's diameter due to reworking, consists in the fact that the guiding devices which lead the coolant into the channels 5 never need to be adjusted.

Preferably these guiding and connection devices are so designed , that at least one pair of channels is connected in series, whereby the leading of the coolant into the channels can take place on one and the same end of the roll as the leading out. Hereby the guiding of the coolant inside the roll is considerably simplified due to the fact that internal runback channels in the roll can be avoided. Furthermore calculations show that the cooling effect can be improved substantially without any noticeable increase in pumping power.

The invention is not confined to internally cooled casting rolls, i.e. the arrangement of supporting rods between the roll core and the shell is also convenient if the coolant does not flow through the channels formed by the rods and the shell. In any case the advantage prevails that the roll core itself never needs to be reworked and its effective diameter can be restored to a required—and particularly to the original-dimension by simply replacing the rods.

What I claim:

1. Casting roll with a roll shell and a roll core, wherein the roll core has grooves with in-laid rods which protrude radially from the grooves and the roll shell is placed onto the rods.

2. Casting roll as claimed in claim 1, wherein between said rods a channel is formed and thus dimensioned as to allow for the flowing through of a coolant.

3. Casting roll as claimed in claims 1 or 2 wherein the rods are exchangable.

4. Casting roll as claimed in claim 1, wherein the rods have a rectangular cross-section.

5. Casting roll as claimed in claim 1, wherein the rods have a trapezoidal cross-section and are inserted into dove-tail shaped grooves.

6. Casting roll as claimed in claim 1, wherein the rods have a circular cross-section.

7. Casting roll as claimed in claim 1, wherein the rods have a greater capacity of resistance to wear than the roll shell.

* * * * *